US006121594A

United States Patent [19]

Joines et al.

[11] Patent Number: 6,121,594

[45] Date of Patent: Sep. 19, 2000

[54] METHOD AND APPARATUS FOR RAPID HEATING OF FLUIDS

[75] Inventors: William T. Joines; J. Michael Drozd, both of Durham, N.C.

[73] Assignee: Industrial Microwave Systems, Inc., Morrisville, N.C.

[21] Appl. No.: 08/965,609

[22] Filed: Nov. 6, 1997

[51] Int. Cl.[7] ..... H05B 6/74; H05B 6/80

[52] U.S. Cl. ..... 219/688; 219/745; 219/756; 219/762

[58] Field of Search ..... 219/687, 688, 219/689, 745, 746, 732, 762, 763, 756

[56] References Cited

U.S. PATENT DOCUMENTS

| | | | |
|---|---|---|---|
| 2,612,596 | 9/1952 | Gross | 219/745 |
| 3,461,260 | 8/1969 | Bremer | 219/745 |
| 3,946,187 | 3/1976 | MacMaster et al. | 219/745 |
| 4,004,122 | 1/1977 | Hallier | 219/746 |
| 4,114,011 | 9/1978 | Stubbs et al. | 219/687 |
| 4,400,357 | 8/1983 | Hohmann . | |
| 4,558,197 | 12/1985 | Wyatt | 219/732 |
| 4,861,956 | 8/1989 | Courneya . | |
| 4,994,638 | 2/1991 | Iorns et al. | 219/732 |
| 5,039,495 | 8/1991 | Kutner . | |

*Primary Examiner*—Philip H. Leung
*Attorney, Agent, or Firm*—Burns, Doane, Swecker & Mathis, L.L.P.

[57] ABSTRACT

A method and apparatus for heating fluids is disclosed. One or more receptacles for holding fluids are located in an interior cavity formed by an exterior conductive surface. In one embodiment, the receptacles are spaced from a side of the exterior conductive surface a distance equal to an odd multiple of ¼ of a wavelength. In another embodiment, bases of the receptacles are spaced a distance equal to slightly less than an odd multiple of ¼ of a wavelength from the bottom of the exterior conductive surface. In a further embodiment, a receptacle has a pointed base for enhancing the heating of fluids. Furthermore, receptacles can be formed with bases spaced an odd multiple of ¼ of a wavelength from at least two adjacent sides of the exterior conductive surface. Receptacles can be formed in a platform that may be made to fit into preexisting electromagnetic heating chambers.

20 Claims, 4 Drawing Sheets

METHOD AND APPARATUS FOR RAPID HEATING OF FLUIDS

FIELD OF THE INVENTION

This invention relates to electromagnetic energy and more particularly to the rapid heating of fluids.

BACKGROUND OF THE INVENTION

In recent years, interest in using microwave signals for applications in many industrial and medical settings has grown dramatically. One such setting is the sterilizing of medical instruments and other objects. Many devices employ microwaves for steam sterilization. For example, U.S. Pat. No. 4,861,956 describes a "Microwave/steam sterilizer" in which microwaves are used to heat water vapor which in turn heats the objects to be sterilized. In other devices, the object to be sterilized is microwave heated together with a liquid that vaporizes during heating. U.S. Pat. No. 5,039,495 describes such a device. In the disclosed device, objects are placed in a microwave-permeable pouch together with a liquid and the arrangement is exposed to microwave energy.

Although many microwave/steam sterilizers are in use, the prior art has only partially explored adapting the shapes of microwave structures to maximize the efficiency of heating liquids. U.S. Pat. No. 4,400,357 discloses a narrow receptacle for enhanced vaporizing of a liquid in the context of a sterilization device. That patent also discloses use of bifocal radiation to enhance heating of a liquid. However, that patent does not disclose locating receptacles at electromagnetic field peaks. That patent also does not disclose a pointed receptacle base for creating a region of increased field intensity near the liquid.

Efficient heating of liquids is particularly important in the context of autoclaves which rely on higher pressures for enhanced sterilizing. At higher pressures, liquids must be heated to higher temperatures in order to create vapor. Thus, high-pressure sterilizers would particularly benefit from increased efficiency in liquid heating.

Another context in which efficient heating of liquids is particularly important is in the context of steaming vegetables and other foods. When steaming vegetables in a microwave, it is desirable for the steam, rather than the microwave energy, to cook the vegetables. As a result, it is important to boil the water rapidly so that the vegetables are steamed quickly, before overexposure to microwaves gives them an rubbery texture. Although microwave steamers exist in the marketplace today, they are not designed optimally to expose the water to regions of peak field intensity.

SUMMARY OF THE INVENTION

These and other drawbacks, problems, and limitations of conventional products are overcome according to exemplary embodiments of the present invention. In one exemplary embodiment, a receptacle for fluids is introduced into an electromagnetic heating device. In a further exemplary embodiment, an electromagnetic chamber is designed so that an electromagnetic field is oriented to promote rapid heating of fluids in the receptacle.

In another embodiment, one or more receptacles for holding fluids are located in an interior cavity formed by an exterior conductive surface. The receptacles are spaced from a side of the exterior conductive surface a distance equal to an odd multiple of ¼ of a wavelength.

In another embodiment, the bases of the receptacles are spaced a distance equal to slightly less than an odd multiple of ¼ of a wavelength from the bottom of the exterior conductive surface.

In a further embodiment, a receptacle has a pointed base for enhancing the heating of conductive fluids. In another embodiment, receptacles are formed in a platform that may be made to fit into preexisting electromagnetic heating chambers.

In a further embodiment, the electromagnetic wave is introduced through a wave guide aperture through an upper portion of the conductive surface. The electric field is polarized parallel to a first side of the aperture and perpendicular to a second side of the aperture.

In a preferred embodiment, the receptacles are formed in the shape of inverted cones. Each receptacle has a pointed base and each pointed base is spaced a distance equal to an odd multiple of ¼ wavelength from at least two adjacent sides of the exterior conductive surface and is spaced a distance equal to slightly less than an odd multiple of ¼ wavelength from the bottom of the conductive surface.

BRIEF DESCRIPTION OF THE DRAWINGS

Embodiments of the present invention will be better understood with reference to the accompanying drawings in which.

DETAILED DESCRIPTION OF PREFERRED EMBODIMENTS

Figure 1:
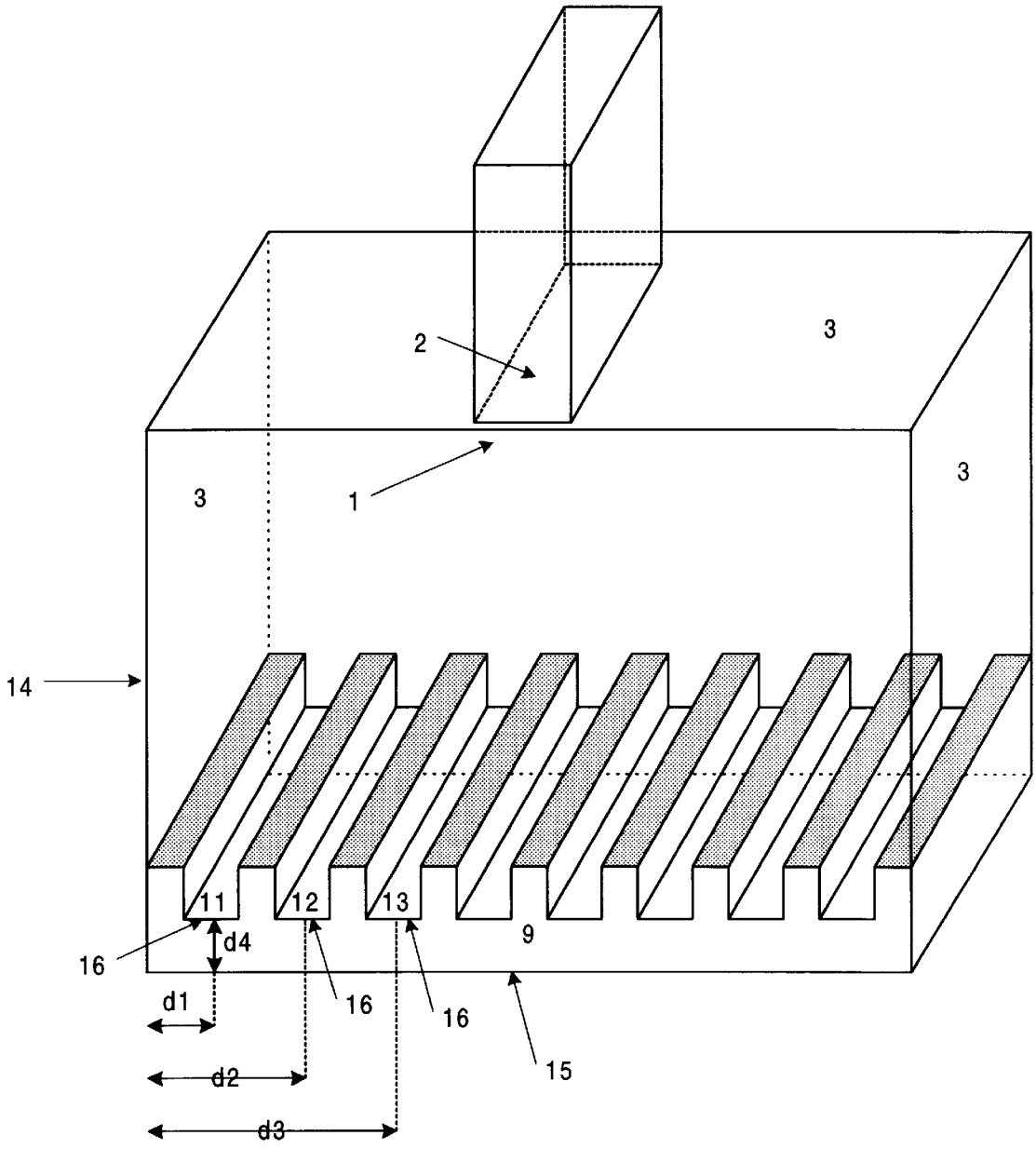
FIG. 1 is a device for electromagnetic heating of fluids in accordance with the present invention.

Referring now to the drawings, FIG. 1 illustrates a device 10 in accordance with the present invention. Electromagnetic energy is introduced into interior region 1 through aperture 2. Conductive surface 3 has a first side 14 and a bottom 15. Platform 9 has receptacles 11, 12, and 13 for holding water or other fluids (not shown). The term "fluids" as used herein includes both liquids and gases. Many of the applications for which the present invention is suited involve the heating of water or other liquids. However, the present invention is also useful for heating gases that collect in the receptacles illustrated in these exemplary embodiments.

Receptacle 11 is spaced from side 14 a distance d1 equal to ¼ of a wavelength ($\lambda/4$). Receptacle 12 is spaced from side 14 a distance d2 equal to ¾ of a wavelength ($\lambda/4$). Receptacle 13 is spaced from side 14 a distance d3 equal to ⅝ of a wavelength ($5\lambda/4$). It is well known in the art that the wavelength $\lambda$ of an electromagnetic wave depends on the relative dielectric constant $\epsilon_r$ of the material in which the wave exists. This dependence is given by the equation $\lambda=(3\times10^8\ \mathrm{m/s})\div(f)(\epsilon_r)^{1/2}$. Thus, the measure of distances d1, d2, and d3 will depend on the material chosen to occupy the space between side 14 and receptacles 11, 12, and 13. In the case of device 10, this will depend on the material chosen for platform 9.

Receptacles 11, 12, and 13 are spaced from side 14 a distance equal to an odd multiple of $\lambda/4$ so that the receptacles will likely be near a peak of the magnitude of the electric field (not shown). It will be appreciated in the art that the electric field will have a minimum magnitude at conductive surface 3, including side 14. Thus, the field should be near its peak magnitude at distances from side 14 equal to odd multiples of $\lambda/4$ ($\lambda/4$, $3\lambda/4$, $5\lambda/4$, etc.). Locating fluid-filled receptacles at or near these field peaks enhances the heating of the fluid. Of course, it will be appreciated in the art that if distance d1, d2, or d3 is close to but not exactly equal to $\lambda/4$, the device would still be within the spirit of the present invention because the receptacle would still be located near a region of peak field intensity.

In another embodiment, bases 16 of the receptacles are spaced from bottom 15 a distance d4 equal to slightly less than $\lambda/4$. It will be appreciated by those skilled in the art that the electric field in interior region 1 will be at a minimum at bottom 15 of conductive surface 3. Thus, the electric field (not shown) should have magnitude peaks at or near distances from bottom 15 equal to odd multiples of $\lambda/4$. By making distance d4 slightly less than $\lambda/4$, peaks of the electric field will penetrate the fluid, enhancing the heating of the fluid. Exactly how much less than $\lambda/4$ distance d4 is will depend on the amount of fluid in the receptacle and can be discovered for a particular application without undue experimentation.

Figure 2:
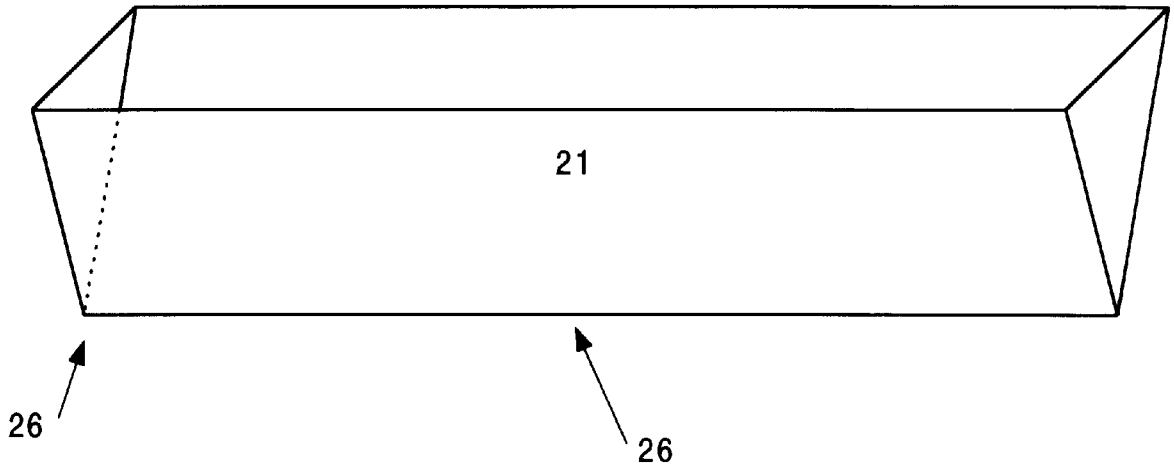
FIG. 2 is a receptacle with a pointed base in accordance with the present invention.

FIG. 2 illustrates a receptacle 21 with a pointed base 26 in accordance with the present invention. Pointed base 26 forms a v-shaped groove. A pointed base will enhance heating of fluids that have electrical conductivity, such as ordinary tap water. It will also enhance heating of fluids that are not conductive but have a relatively high dielectric constant, such as distilled or de-ionized water. It is well known in the art that an electromagnetic field will have "hot spots" of particularly high intensity around pointed edges of conductors or dielectrics placed inside the field. This phenomenon is observed when, for example, a sharp metal instrument is placed inside a microwave oven. A glow or "corona" may appear around the sharp points of such an instrument due to the high field intensity. Pointed base 26 effectively brings a fluid in receptacle 21 to a point. Thus, a conductive fluid or a fluid with a relatively high dielectric constant placed in receptacle 21 will experience enhanced heating due to the enhanced field intensity around the fluid at pointed base 26.

Figure 3:
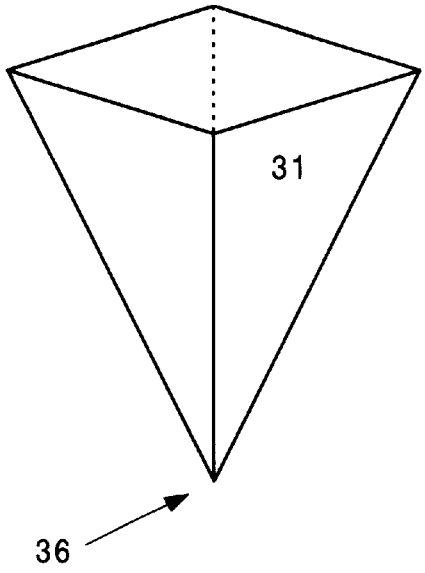
FIG. 3 is another receptacle with a pointed base in accordance with the present invention.

FIG. 3 illustrates another receptacle 31 with a pointed base 36 also in accordance with the present invention. Pointed base 36 forms an inverted pyramid shape. Other shaped bases in accordance with the present invention are readily imaginable. For example, an inverted diamond or inverted cone shaped base would also form a point that would provide for enhanced heating of conductive fluids.

Figure 4:
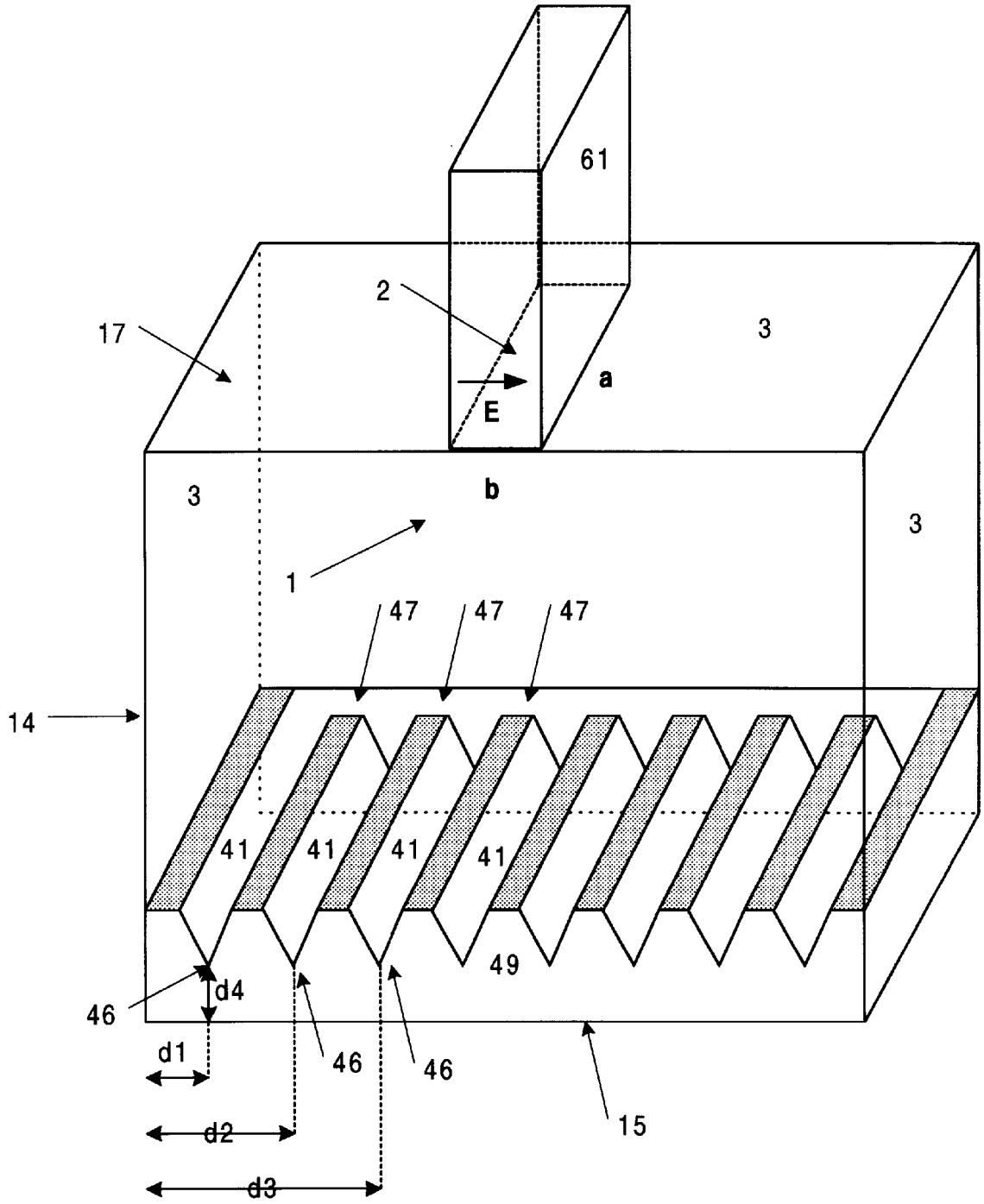
FIG. 4 is a further embodiment of the present invention.

FIG. 4 illustrates a cut-away view of an embodiment of the present invention. In FIG. 4 the front side of cavity 1 and platform 49 is truncated to better illustrate features of this embodiment. In this embodiment, platform 49 contains a series of eight receptacles 41 with pointed bases 46. Platform 49 also contains connector sections 47 which connect receptacles 41. Sections 47 allow for fluid flow between receptacles. Thus, receptacles 41 together with connector sections 47 form a continuous channel. Objects to be heated for sterilization or for other purposes might be placed on top of platform 49 or elsewhere in interior region 1. Receptacles 41 are each spaced from side 14 a distance equal to an odd multiple of $\lambda/4$. Bases 46 are spaced from bottom 15 a distance equal to slightly less than an odd multiple of $\lambda/4$.

Also, in this embodiment aperture 2 for introducing an electromagnetic wave (not shown) into interior region 1 is located at a midway point in a top 17 of conductive surface 3 in order to promote constructive interference for a resulting standing wave (not shown). The electric field of the electromagnetic wave (not shown) is polarized to maximize penetration through platform 49. This may be achieved by introducing the electromagnetic wave (not shown) through aperture 2 at the boundary of wave guide 61 and interior region 1. Aperture 2 has sides a and b where the length of side a is greater than the length of side b. The electric field (not shown) is polarized parallel to side b and perpendicular to side a as illustrated by the arrow labelled E.

Note that platform 49 with its accompanying receptacles 41 and connector sections 47 might be manufactured separately from exterior conductive surface 3. Thus the present invention might be used in conjunction with preexisting electromagnetic heating chambers.

Figure 5:
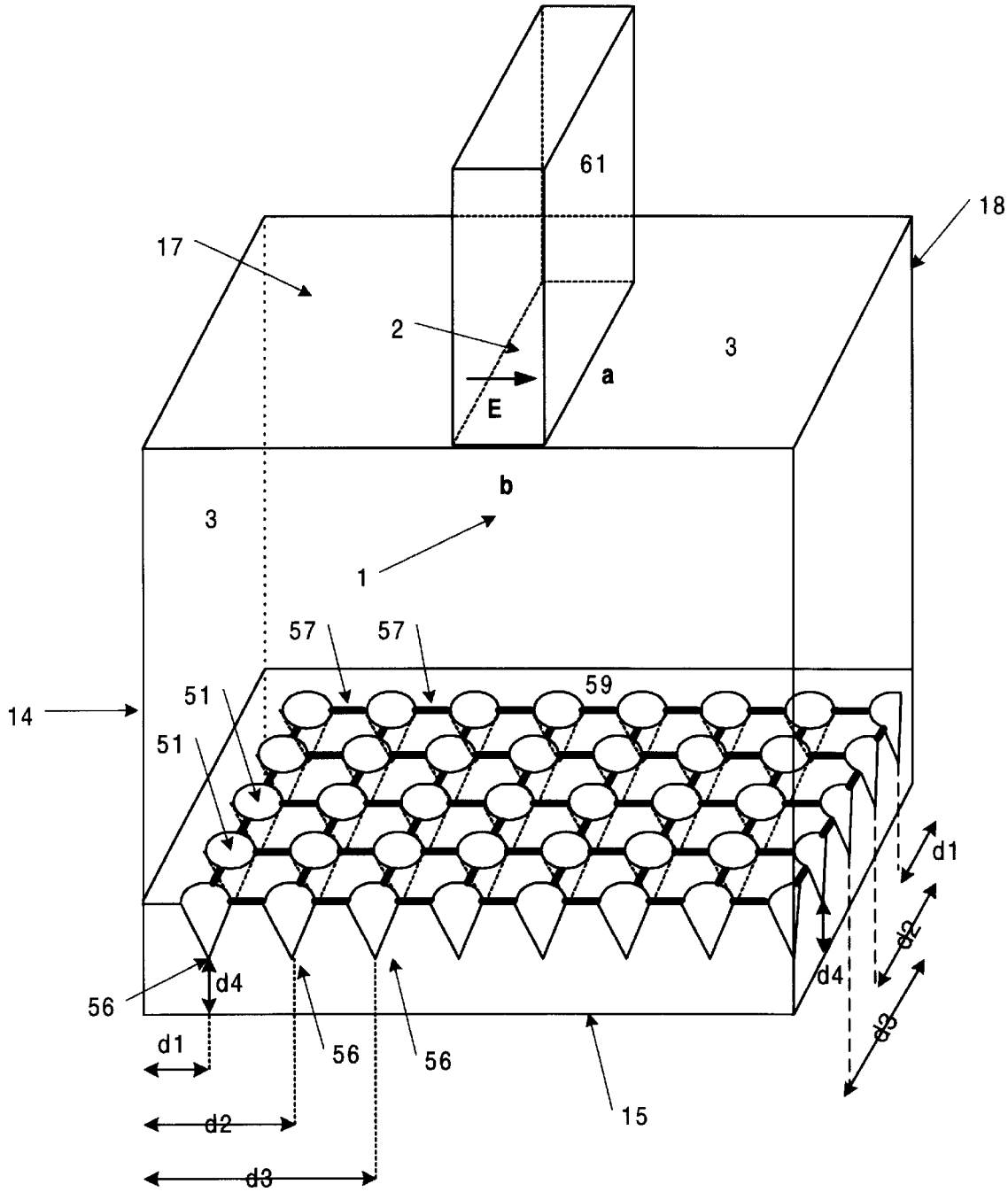
FIG. 5 is a preferred embodiment of the present invention.

FIG. 5 illustrates a cut-away view of a preferred embodiment of the present invention. In FIG. 5 the front side and the right hand side of cavity 1 and platform 59 are truncated to better illustrate features of the preferred embodiment. Platform 59 contains forty receptacles 51 with pointed bases 56. Receptacles 51 are each in the shape of an inverted cone. Platform 59 also contains connector sections 57. Connector sections 57 allow for fluid flow between receptacles 51. Thus, receptacles 51 together with connector sections 57 form a continuous channel.

Conductive surface 3 has first side 14 and a second side 18. Second side 18 is adjacent to first side 14. (In this illustration, second side 18 is the back side of conductive surface 3). Peaks of the electric field occur at distances from a side of conductive surface 3 equal to odd multiples of $\lambda/4$. Thus, the heating of fluids may be further enhanced by locating receptacles 51 a distance equal to odd multiples of $\lambda/4$ from two adjacent sides of conductive surface 3. Therefore, each receptacle 51 is located a distance from first side 14 equal to an odd multiple of $\lambda/4$. Each receptacle 51 is also located a distance from second side 18 equal to an odd multiple of $\lambda/4$. Also, each pointed base 56 is located a distance from bottom 16 a distance equal to slightly less than $\lambda/4$.

When using the preferred embodiment illustrated in FIG. 5, the electromagnetic wave (not shown) should be introduced through aperture 2 located at a midway point in top 17 of exterior conductive surface 3. The electric field should be polarized parallel to side b of aperture 2 and perpendicular to side a of aperture 2. Platform 59 with its accompanying receptacles 51 and connector sections 57 might be manufactured separately from exterior conductive surface 3. Thus the present invention might be used in conjunction with preexisting electromagnetic heating chambers. The number of receptacles would depend in part on the size of the chamber and the operating frequency.

One particularly advantageous application of the present invention is for use in an autoclave. Due to higher pressures in an autoclave, fluids need more heating in order to vaporize. The present invention will make heating of fluids more efficient, thus enhancing steam sterilization in the context of an autoclave that makes use of microwave energy. However, many other uses and embodiments of the present invention will be recognized by those skilled in the art. For example, platform 59 along with receptacles 51 and connector sections 57 might be readily adapted for use as a steamer in a consumer microwave oven. It is intended, therefore, that the forgoing description of the invention and the illustrative embodiments be considered in the broadest aspects and not in a limited sense.

We claim:

1. A device for heating a fluid, the device comprising:

an exterior conductive surface enclosing an interior region therein, the exterior conductive surface comprising a bottom surface and a first side surface;

an aperture for introducing an electromagnetic wave having a predetermined wavelength to the interior region, the aperture formed on a portion of the conductive surface; and a receptacle for holding a fluid, the receptacle formed within the interior region, the receptacle comprising a bottom and a side, the bottom having an inside surface and an outside surface, said inside surface comprising a pointed base including a plurality of pointed projections for holding the fluid on the inside surface between the pointed projections.

2. A device as described in claim 1, the receptacle spaced from the first side of the conductive surface a distance equal to an odd multiple of a ¼ of lal the predetermined wavelength.

3. A device as described in claim 2, the exterior conductive surface comprising a second side surface adjacent to the first side surface, the receptacle spaced from the second side surface of the conductive surface a distance equal to an odd multiple of a ¼ of the predetermined wavelength.

4. A device as described in claim 3, the pointed base spaced from the bottom surface of the conductive surface a distance slightly less than an odd multiple of a ¼ of the predetermined wavelength.

5. A device as described in claim 4, the aperture comprising a first aperture side and a second aperture side, the aperture positioned at a midway point in the conductive surface above the interior region, the aperture connected to a waveguide such that an electric field of the electromagnetic wave is polarized perpendicular to the first aperture side and parallel to the second aperture side.

6. A device as described in claim 1, the pointed base between the fluid and the bottom surface of the conductive surface, the side of the receptacle between the fluid and the first side surface of the conductive surface, the aperture formed on a portion of the conductive surface opposite the bottom surface of the conductive surface.

7. A device as described in claim 1, the plurality of pointed projections forming an inverted cone.

8. A device for evaporating a liquid, the device comprising:

an exterior conductive surface enclosing an interior region therein, the exterior conductive surface comprising a bottom surface and a first side surface;

an aperture for introducing an electromagnetic wave having a predetermined wavelength to the interior region, the aperture formed on a portion of the conductive surface; and a plurality of receptacles formed within the interior region, each receptacle spaced from the first side of the conductive surface a distance equal to a different odd multiple of a ¼ of the predetermined wavelength so as to facilitate evaporation of a liquid contained therein.

9. A device as described in claim 8, the exterior conductive surface comprising a second side surface adjacent to the first side surface, each receptacle spaced from the second side of the conductive surface a distance equal to an odd multiple of a ¼ of the predetermined wavelength so as to facilitate evaporation of a liquid contained therein.

10. A device as described in claim 9, each receptacle comprising a pointed base.

11. A device as described in claim 10, wherein at least two of the receptacles arc connected.

12. A device as described in claim 8, each receptacle comprising a pointed base.

13. A device as described in claim 12, wherein at least two of the receptacles are connected.

14. A device as described in claim 8, wherein at least two of the receptacles are connected.

15. A method for heating a fluid, the method comprising the steps of:

placing a fluid in a receptacle in an interior region surrounded by an exterior conductive surface, the receptacle comprising an inside surface and an outside surface, said inside surface comprising a pointed base including a plurality of pointed projections for holding the fluid on the inside surface between the pointed projections; and delivering electromagnetic energy having a predetermined wavelength to the interior region.

16. A method as described in claim 15, the exterior conductive surface comprising a first side surface, the receptacle spaced from the first side surface a distance equal to a different odd multiple of a ¼ of the predetermined wavelength.

17. A method as described in claim 16, the exterior conductive surface comprising a second side surface adjacent to the first side surface, the receptacle spaced from the second side surface a distance equal to a different odd multiple of a ¼ of the predetermined wavelength.

18. A method as described in claim 16, the exterior conductive surface comprising a bottom surface, the pointed base spaced form the bottom surface a distance slightly less than an odd multiple of a ¼ of the predetermined wavelength.

19. A method as described in claim 18, the exterior conductive surface comprising a top, the top comprising a midway point, an aperture for delivering an electromagnetic energy to the interior region is located at the midway point, and an electric field of the electromagnetic wave is polarized perpendicular to a first aperture side and parallel to a second aperture side.

20. A method as described in claim 15, the plurality of pointed projections forming an inverted cone.

* * * * *